United States Patent [19]

Phelps

[11] 4,299,146

[45] Nov. 10, 1981

[54] CLAMPING DEVICE

[76] Inventor: Richard E. Phelps, 12155 Oak Rd., Otisville, Mich. 48463

[21] Appl. No.: 88,532

[22] Filed: Oct. 26, 1979

[51] Int. Cl.[3] ..... B25B 7/02

[52] U.S. Cl. ..... 81/420; 81/425 A; 269/258

[58] Field of Search ..... 81/418, 420, 425 R, 81/425 A, 426, 427; 269/258

[56] References Cited

U.S. PATENT DOCUMENTS

| | | | |
|---|---|---|---|
| 1,063,332 | 6/1913 | Diehl | 269/258 |
| 1,617,703 | 2/1927 | Christianson | 81/420 |
| 2,325,387 | 7/1943 | Fredrickson | 269/258 |
| 2,584,353 | 2/1952 | Keiser | 81/426 |
| 3,842,696 | 10/1974 | Wayne | 81/425 R |
| 4,075,749 | 2/1978 | Hubeny | 81/426 |

*Primary Examiner*—James L. Jones, Jr.
*Attorney, Agent, or Firm*—Gifford, Van Ophem, Sheridan & Sprinkle

[57] ABSTRACT

A clamping device having a first jaw, a second jaw and means for urging said first jaw toward said second jaw wherein a clamping plate is rigidly secured to the first jaw and a second clamping plate is pivotally secured to the second jaw so that the device can clampingly engage two workpieces having different diameters at the same time. In addition, one of the clamping plates includes a pair of swivelly mounted support members having a support surface so that regardless of the pivot position of the second clamping plate, the support surfaces flatly abut against the workpieces to urge them tightly against the flat surface of the other clamping plate in a coplanar alignment.

5 Claims, 3 Drawing Figures

CLAMPING DEVICE

BACKGROUND OF THE INVENTION

I. Field of the Invention

The present invention relates generally to clamping devices and more particularly to such devices having a clamping plate pivotally secured to one of the jaws so that two pieces having different widths can be held together in a coplanar relationship.

II. Description of the Prior Art

The fabrication of metal parts often requires that two pieces of different size be welded together. When these pieces are laid end to end and must be joined together at their edges, it is often difficult to maintain the pieces in an abutting relationship while a weld is made along the entire abutting portions of the two pieces. This is especially true when the pieces are cylindrical or of an irregular shape.

Many previously-known clamping devices are unable to clampingly engage workpieces of two different sizes at the same time since the jaws of previously-known clamping devices are flat and rigid and thus can only engage the wider of the two pieces. Thus, spacers must be placed between the clamping jaw and the smaller workpiece in order to clamp the workpieces in an abutting position. Nevertheless, such an arrangement is disadvantageous in that when the workpieces are small or of an irregular shape, it is extremely difficult, if not impossible, to accurately align the workpieces while inserting the spacers between the jaws of the clamping device. Moreover, the spacers as well as the workpieces must be accurately aligned between the jaws of the clamping device and such alignment is time-consuming as well as difficult.

SUMMARY OF THE PRESENT INVENTION

The present invention overcomes the above-mentioned disadvantages by providing a clamping device comprising a pair of jaws, a first elongated clamping plate secured to one of the jaws, and a second elongated clamping plate pivotally secured to the other jaw. In addition, a resilient means normally positions the second clamping plate substantially parallel to and in registration with the first clamping plate. One of the clamping plates is provided with at least two support members having a contact surface facing toward the other clamping plate so that a workpiece can be firmly abutted by the contact surface against the other clamping plate. Preferably, the support members are swivelly secured to the one clamping plate and include an enlarged contact surface so that a clamping force is exerted upon an enlarged area of the workpiece regardless of the pivoted position of the second clamping plates. An elongated handle means is secured to the first jaw and an elongated lever means selectively displaces the second jaw with respect to the first so that displacement of the lever means toward the elongated handle urges the second jaw towards the first jaw and thus displaces the support members toward the opposite jaw.

As shown in the drawing and described in the detailed description of the preferred embodiment of the present invention, the clamping device employs a previously-known tool having a first jaw, a second jaw, means for selectively displacing the first jaw with respect to the second jaw between a first position in which the jaws are spaced widely apart and a second position in which the jaws abut against each other, and means for maintaining a variable predetermined distance between the jaws as the first means urges the jaws from the first position toward the second position. Such a device, like the one known by the trademark Vise-grip wrench, is especially well adapted for use with the present invention. Nevertheless, it is to be understood that other previously-known clamping members, such as common pliers, can be employed in the construction of the device of the present invention.

BRIEF DESCRIPTION OF THE DRAWING

The present invention will be more clearly understood by reference to the following detailed description in conjunction with the accompanying drawing in which.

DETAILED DESCRIPTION OF THE PRESENT INVENTION

Figure 1:
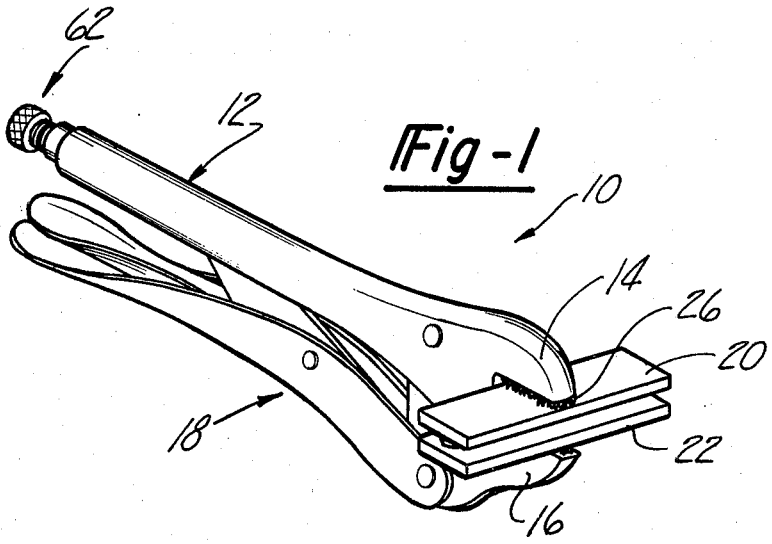
FIG. 1 is a perspective view of a preferred embodiment of the clamping device of the present invention.

Referring now to FIG. 1, the clamping device 10 of the present invention is thereshown comprising a jawed clamping tool 12 having a first jaw or support 14, a second jaw or support 16 and a lever means 18 for displacing the second jaw 16 with respect to the first jaw 14. A first clamping plate 20 is secured by appropriate fastening means such as the weld 26 to the first jaw 14. A second elongated clamping plate 22 is pivotally secured to the second jaw 16 in a manner to be hereinafter described in detail.

Two spaced apart support members are secured to opposite ends of one of the clamping plates. These support members can be pins rigidly secured to one surface of the clamping plate, but in the preferred embodiment shown in FIGS. 2 and 3, two support members 30 and 32 are swivelly secured to one of the clamping plates 20 and 22. As shown in the drawing in FIGS. 2 and 3, the support members are preferably secured to the lower clamping plate 22 which is pivotally connected to the second jaw 16. As shown, the support members 30 and 32 include sockets adapted to receive the balls 34 and 36 on the pins 38 and 40, respectively and the pins are fixedly secured to the upper surface of the lower clamping plate 22. The support members 30 and 32 swivel about the balls 34 and 36, respectively, so that regardless of the pivot position, the clamping plate 22 and the shape of the workpieces to be clamped, the enlarged top surfaces 42 and 44 of the support members 30 and 32 respectively are aligned with the abutting surfaces of the workpieces 70 or 72 as shown in FIG. 2 or with the lower surface of the upper clamping plate 20 as shown in FIG. 3.

The lower clamping plate 22 is pivotally secured to the lower jaw 16 by the pivot means 50 having its pivotal axis 52 aligned parallel to the jaw 16 so as to extend outwardly from the free end of the jaw and aligned transversely to the elongated clamping plate 22. In the preferred embodiment shown in the drawing, the pivot means 50 comprises a hollow cylindrical sleeve 54 welded to the jaw 16 by the welds 56. A pivot pin 58 having a length greater than the length of the sleeve 54 is rotatably received within the sleeve 54 and is secured at each end by appropriate means such as the welds 60 so that the clamping plate 22 slides freely over the sleeve 54 as the hinge pin 58 rotates within the sleeve 54.

Figure 2:
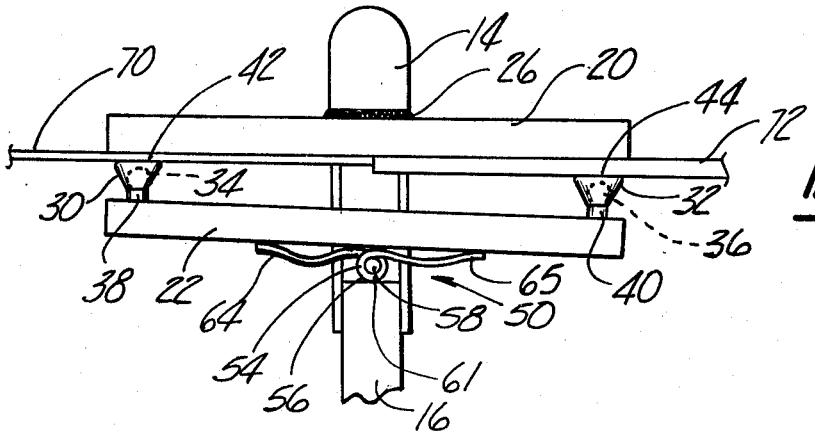
FIG. 2 is a fragmentary front plan view of the device shown in FIG. 1 and showing a pair of workpieces clamped into position.
Figure 3:
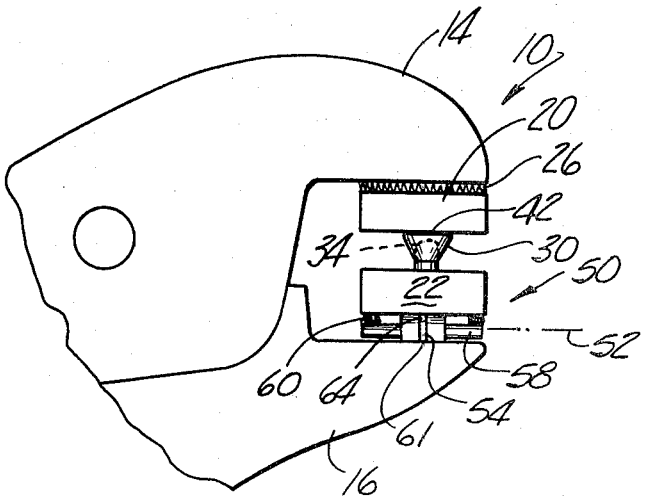
FIG. 3 is a fragmentary side plan view of the device shown in FIGS. 1 and 2.

As best shown in FIGS. 2 and 3, a wound spring 61 having extended ends 64 and 65 is secured around the sleeve 54. The ends 64 and 65 engage opposite ends of the clamping plate 22 so that the wound spring 61 normally urges the clamping plate 22 into a parallel but registering position with respect to the clamping plate 20.

Referring again to FIG. 1, the tool 12 includes means for maintaining a predetermined distance between the jaws 14 and 16 when the lever means 18 has been actuated to bring the jaws 14 and 16 into their clamping positions. This means is generally designated in FIG. 1 by reference character 62. Although the means 62 is functionally important in using the device of the preferred embodiment of the present invention, the structure of that means is previously well known and will not be discussed here for the sake of brevity.

Having defined the important structural features of the device of the present invention, the operation of the device can be easily described. The jaws 14 and 16 are opened wide so that the support surfaces 42 and 44 of the support members 30 and 32 respectively are spaced apart from the lower surface of the clamping plate 20 so that the workpieces can be easily inserted therebetween. As shown in FIG. 2, the workpieces 70 and 72 are elongated bars having different diameters. Each workpiece 70 and 72 is inserted between the jaws from opposite ends of the clamping plates so that they meet substantially at the center of the clamping plates as shown at 74 in FIG. 2.

The lever means 18 is then actuated to close the jaws of the tool 12 so that the support surface 44 of the support member 32 tightly abuts against the workpiece 72 and presses it against the lower surface of the clamping plate 20. As actuation of the lever means continues to close the jaws 14 and 16, the positioning force of spring 61 is overcome and the clamping plate 22 pivots to the position shown in FIG. 2. Nevertheless, the support surface 44 remains in substantial contact with workpiece 72. At the same time, the support surface 42 of the support member 32 tightly abuts against the workpiece 70 to press it tightly against the lower surface of the clamping plate 20.

Since the lower surface of the clamping plate 20 is flat, the upper surface of the workpieces 70 and 72 are held in a substantially coplanar alignment. Although the clamping plate 22 pivots about the pivot means 50, due to the difference in the spacing between the clamping plate 20 and support member 30 and the spacing between the clamping plate 20 and the support member 32, the support member 30 and the support member 32 rotate or swivel about the ball 34 and 36, respectively so that the surface 42 and the surface 44 flatly abut against the lower surface of the workpiece 70 and the workpiece 72 respectively. Thereafter, portions of the workpieces 70 and 72 extending outwardly from the front edge of the clamping plates 20 and 22 can be welded together at the junction 74 so that the workpieces 70 and 72 can be joined to form a single workpiece having a planar surface.

Thus, the present invention provides a device which permits two differently sized workpieces to be clamped together in a coplanar and abutting relationship so that they can be fastened together to form a single piece. In addition, the device can be easily manipulated by one hand of the user while the other hand is used to properly position the workpieces between the clamping plates and then weld or otherwise fasten them together since the clamping action is easily produced by merely squeezing the lever means 18 toward the elongated handle of the tool 12.

Having thus described my invention many modifications will become apparent to those skilled in the art to which it pertains without departing from the scope or spirit of the present invention as defined in the appended claims.

What is claimed is:

1. A clamping device for holding two differently-sized workpieces in an abutting relationship wherein a surface of each workpiece is aligned in a single plane, said clamping device comprising a first support having a first clamping plate mounted thereon, a second support having a second clamping plate mounted thereon, means spaced from said clamping plate and mounting said first support to said second support, said means permitting relative movement of said first clamping plate in a line of movement toward and away from said second clamping plate, said first clamping plate being elongated in a direction transverse to the line of movement of said clamping plates and in a direction oblique to said mounting means, said second clamping plate being elongated in a direction parallel to the direction of elongation of said first clamping plate, means pivotally mounting said second plate to said second support on an axis transverse to the direction of elongation of said second clamping plate, at least two support members swivelly secured to said second clamping plate, and extending toward said first clamping plate, said support members being spaced from each other in the direction of elongation of said clamping plates, whereby with two differently sized, elongated workpieces inserted between said clamping plates with said workpieces in abutting relationship said second clamping plate will pivot with respect to said second support and said support members will swivel with respect to said second clamping plate upon relative movement of said clamping plates toward each other to securely clamp said workpieces in abutting relationship between said clamping plate.

2. The clamping device as defined in claim 1 wherein said mounting means comprises an elongated handle having said first support fixedly secured thereto, and lever means secured to said second support for displacing said second support toward said first support, as said lever means is urged toward said handle.

3. The clamping device as defined in claim 1 and further comprising means for limiting the minimum distance between said support members and said first clamping plate when said clamping plates are moved toward each other.

4. The clamping device as defined in claim 1 and further comprising resilient means urging movement of said second clamping plate about said pivotal means for normally positioning said second clamping plate substantially parallel to said first clamping plate.

5. The clamping device as defined in claim 1 wherein each of said support members includes an enlarged contact surface facing toward said other clamping plate.

* * * * *